US008381917B2

(12) United States Patent
Schmidt

(10) Patent No.: US 8,381,917 B2
(45) Date of Patent: Feb. 26, 2013

(54) METHOD FOR DESTROYING BANKNOTES

(75) Inventor: Alfred Schmidt, München (DE)

(73) Assignee: Giesecke & Devrient GmbH, Munich (DE)

( * ) Notice: Subject to any disclaimer, the term of this patent is extended or adjusted under 35 U.S.C. 154(b) by 128 days.

(21) Appl. No.: 12/440,112

(22) PCT Filed: Aug. 28, 2007

(86) PCT No.: PCT/EP2007/007514

§ 371 (c)(1),
(2), (4) Date: Apr. 22, 2009

(87) PCT Pub. No.: WO2008/028581

PCT Pub. Date: Mar. 13, 2008

(65) Prior Publication Data

US 2010/0032351 A1 Feb. 11, 2010

(30) Foreign Application Priority Data

Sep. 8, 2006 (DE) ..... 10 2006 042 186

(51) Int. Cl.
*B07C 5/00* (2006.01)

(52) U.S. Cl. ..... 209/534; 209/10; 194/206

(58) Field of Classification Search ..... 209/10, 209/534; 194/206–210
See application file for complete search history.

(56) References Cited

U.S. PATENT DOCUMENTS

| | | | | |
|---|---|---|---|---|
| 3,552,563 | A | 1/1971 | Smith | |
| 3,759,382 | A * | 9/1973 | Walkley et al. | 209/534 |
| 3,932,272 | A * | 1/1976 | Carnes et al. | 209/534 |
| 3,976,198 | A * | 8/1976 | Carnes et al. | 209/534 |
| 4,255,057 | A * | 3/1981 | Williams | 356/435 |
| 4,346,851 | A | 8/1982 | Bernardi | |
| 4,473,157 | A * | 9/1984 | Hirose et al. | 209/534 |
| 4,587,408 | A * | 5/1986 | Watanabe | 235/379 |
| 4,878,626 | A * | 11/1989 | Leuthold et al. | 241/57 |
| 4,972,958 | A * | 11/1990 | Ito et al. | 209/534 |
| 5,000,322 | A * | 3/1991 | Goi | 209/534 |
| 5,186,334 | A * | 2/1993 | Fukudome et al. | 209/534 |
| 5,310,036 | A * | 5/1994 | Hell | 194/206 |
| 5,478,992 | A * | 12/1995 | Hamada et al. | 235/379 |
| 5,803,446 | A | 9/1998 | Leuthold | |

(Continued)

FOREIGN PATENT DOCUMENTS

| | | | |
|---|---|---|---|
| DE | 100 29 051 | A1 | 12/2001 |
| DE | 10050486 | A1 | 4/2002 |

(Continued)

OTHER PUBLICATIONS

Search Report of German Patent Office regarding German Patent Application No. 10 2006 042 186.8, May 11, 2007.

*Primary Examiner* — Joseph C Rodriguez

(74) *Attorney, Agent, or Firm* — Bacon & Thomas, PLLC

(57) ABSTRACT

A method for destroying bank notes is provided, wherein bank notes are checked and sorted by at least one bank-note processing machine in at least one decentralized place, whereby unfit bank notes are sorted out in order to be transported to a central place for destruction. It is provided that all bank notes recognized as unfit are stored on a single stack independently of the bank-note denomination and/or orientation recognized during the check, for which purpose a single output pocket of the bank-note processing machine is used for all unfit bank notes.

18 Claims, 4 Drawing Sheets

U.S. PATENT DOCUMENTS

| | | | | |
|---|---|---|---|---|
| 5,923,413 | A * | 7/1999 | Laskowski | 356/71 |
| 6,065,672 | A * | 5/2000 | Haycock | 235/379 |
| 6,094,500 | A * | 7/2000 | Ross et al. | 382/135 |
| 6,098,978 | A | 8/2000 | Bielefeld | |
| 6,182,962 | B1 | 2/2001 | Leuthold | |
| 6,267,372 | B1 | 7/2001 | Mylaeus | |
| 6,739,590 | B2 | 5/2004 | Otsuka | |
| 6,772,886 | B2 | 8/2004 | Werner | |
| 6,835,934 | B2 * | 12/2004 | Nemeth et al. | 250/341.1 |
| 6,889,850 | B2 * | 5/2005 | Amari et al. | 209/534 |
| 7,185,749 | B2 * | 3/2007 | Armanini et al. | 194/302 |
| 7,201,340 | B2 | 4/2007 | Dietrich et al. | |
| 7,225,911 | B2 * | 6/2007 | Yokoi et al. | 194/205 |
| 7,377,423 | B2 | 5/2008 | Demmeler et al. | |
| 7,607,528 | B2 | 10/2009 | Derks | |
| 7,978,899 | B2 * | 7/2011 | Jenrick et al. | 382/135 |
| 8,074,806 | B2 * | 12/2011 | Ozaki et al. | 209/534 |
| 2003/0168849 | A1 | 9/2003 | Reinisch | |
| 2004/0007509 | A1 | 1/2004 | Gubbey et al. | |
| 2004/0039479 | A1 * | 2/2004 | Dietrich et al. | 700/213 |
| 2004/0112998 | A1 | 6/2004 | Schmidt | |
| 2005/0056519 | A1 * | 3/2005 | Yokoi et al. | 194/206 |
| 2005/0241909 | A1 * | 11/2005 | Mazur et al. | 194/207 |
| 2006/0038340 | A1 | 2/2006 | Schinzel-Reiner | |
| 2006/0163797 | A1 | 7/2006 | Schmidt et al. | |
| 2008/0283451 | A1 | 11/2008 | Holl et al. | |
| 2008/0283589 | A1 | 11/2008 | Rapf et al. | |

FOREIGN PATENT DOCUMENTS

| | | | |
|---|---|---|---|
| DE | 10117250 | A1 | 10/2002 |
| DE | 10226540 | A1 | 1/2004 |
| DE | 10236258 | A1 | 2/2004 |
| DE | 10242672 | A1 | 4/2004 |
| DE | 102004033092 | A1 | 1/2006 |
| DE | 102005008747 | A1 | 8/2006 |
| EP | 0 463 930 | A2 | 10/1991 |
| WO | WO 99/27488 | | 6/1999 |
| WO | WO 01/99060 | A1 | 12/2001 |
| WO | WO 2005/114596 | A1 | 12/2005 |

* cited by examiner

METHOD FOR DESTROYING BANKNOTES

BACKGROUND

A. Field

This invention relates to a method for destroying bank notes, wherein bank notes are checked and sorted by means of at least one bank-note processing machine in at least one decentralized place, whereby unfit bank notes are sorted out in order to be transported to a central place for destruction.

B. Related Art

Methods for destroying bank notes wherein bank notes no longer fit for circulation are sorted out and transported to a central place for destruction are known and have been used for a long time. In such methods, bank notes which are accepted e.g. by commercial banks, security transport companies, etc., are checked and sorted in decentralized fashion by means of bank-note processing machines. Sorting of the bank notes is effected according to their denomination and fitness for circulation, i.e. two stacks are formed per denomination, one stack for fit bank notes of the particular denomination and one further stack for unfit bank notes of the particular denomination. Unfit bank notes are understood to mean bank notes that are so soiled and/or damaged that they should not return to circulation. The unfit bank notes are subsequently transported to a central place, e.g. a central bank, and destroyed by the central bank, normally after a recheck.

It has turned out, however, that the known procedure is very elaborate, since the decentralized checking and sorting involves sorting the accepted bank notes with regard to their denomination and fitness. Two output pockets must therefore be provided for each denomination in the bank-note processing machine used. Since well-known currencies normally have seven or more denominations or emissions, fourteen output pockets must already be provided for processing bank notes of one currency. If bank notes of different currencies are to be processed at the same time, the number of output pockets increases accordingly. Moreover, a sort according to orientation of the bank notes is frequently to be performed, which increases the effort further by up to a factor of four if the bank-note processing machine has no elements for turning over and orienting.

Further problems result in the known procedure for destroying unfit bank notes from the fact that the central banks only receive bank notes that have been classified as unfit by the delivering decentralized places. Since the central banks normally make stipulations on what state bank notes must have to be classified as fit or unfit, it is not possible for the central bank to check whether the delivering decentralized places comply with these stipulations, since only the bank notes classified as unfit by the decentralized places reach the central bank. These notes might be mixed with fit bank notes, or not all unfit bank notes are recognized and/or sorted out.

In addition, for example WO 99/27488 A1 discloses a method wherein destruction is effected in decentralized fashion, that is, not carried out by a central bank. In such methods, a sort is likewise effected in a first step by means of a first bank-note processing machine according to denomination and state of the bank notes, i.e. whether the bank notes are fit or unfit. Unfit bank notes are transferred to a special secure room which can be monitored by the central bank. It is additionally transmitted to the central bank how many bank notes of each denomination have been transferred to the room. Destruction of the bank notes is effected in the secure room under monitoring by the central bank by means of a second bank-note processing machine which determines and checks the denomination and number of the bank notes again prior to their destruction. The determined number and denomination is transmitted to the central bank, which compares it to the previously transmitted information on number and denomination of transferred bank notes.

In this variant of bank-note destruction, there is still effected a division and sorting of all bank notes according to their denomination, so that a multiplicity of output pockets are still required for the bank-note processing machine used. The saving of the required transport of unfit bank notes to the central bank is opposed by considerable effort for creating the secure room. Further effort is required for the monitoring of the destruction of unfit bank notes in the secure room by the central bank. Moreover, there will normally be considerably lower utilization of the bank-note processing machine used for destroying unfit bank notes in the secure room, because only the amount of unfit bank notes arising in one decentralized place is destroyed there. It is therefore necessary to install many bank-note processing machines with secure rooms, which causes considerable investment and operating costs.

It is therefore the object of the present invention to specify a method for destroying bank notes wherein unfit bank notes are sorted out in decentralized places and are transported to a central place for destruction, which can be operated with less effort, and in particular makes lower demands on the bank-note processing machines used in the decentralized places.

It is further the object to specify a method for destroying bank notes wherein unfit bank notes are sorted out in decentralized places and transported to a central place for destruction, which permits the central place to have improved monitoring of the sorting out of unfit bank notes carried out in the decentralized places.

BRIEF SUMMARY OF THE DISCLOSURE

This object is achieved according to the invention by a method for destroying bank notes wherein the bank notes are checked and sorted in at least one decentralized place by means of at least one bank-note processing machine, whereby unfit bank notes are sorted out in order to be transported to a central place for destruction.

In the inventive method it is assumed that bank notes are accepted, checked and sorted in at least one decentralized place, whereby all bank notes recognized as unfit are stored on a single stack, i.e. a single output pocket of the bank-note processing machine is used for all unfit bank notes regardless of the bank-note denomination and/or orientation recognized during the check.

The inventive method thus has the advantage that the bank-note processing machines used in decentralized places can be constructed considerably more simply, since they need only have a greatly reduced number of output pockets. Moreover, the further processing of unfit bank notes is simplified, since all unfit bank notes are combined in a single stack. This also reduces the risk upon emptying of the output pockets that fit bank notes might be mistakenly mixed with unfit bank notes when the output pockets for the different denominations are emptied. This reduces the investment costs for the bank-note processing machine, because unfit bank notes no longer need to be separated according to their denomination and/or orientation. The reduced number of output pockets reduces the number of working steps and thus increases throughput.

Further advantages result from the fact that no additional control and monitoring means are necessary in the area of the decentralized bank-note sorting. The sorting out of unfit bank notes can be effected in an unsecured area, since the bank notes are not destroyed and their presence can thus be checked any time.

The area of the central bank likewise requires only the usual control and monitoring means. Moreover, the bank-note processing machine can do without output pockets for fit bank notes when no fit bank notes are contained due to the quality of pre-sorting or when the recovery of any contained fit bank notes is omitted. In this case, the bank-note processing machine requires only one output pocket for rejections, i.e. non-processible or non-recognized bank notes, and one unit for destroying bank notes, e.g. a shredder.

The focus on central destruction creates the framework conditions for an economical design of the security measures in the whole process. This relates both to the physical protection of the security areas for cash processing and to the control by supervisory staff according to the principles of dual custody in the case of unavoidable interventions by customer service or the operator upon malfunctions and disturbances.

In a development, it is provided that the central place is provided with data from the checking and sorting operation of the at least one decentralized place that go beyond information about the number and denomination of the bank notes, and thus their value. For this purpose, not only the bank notes unsuitable for circulation are transmitted to the central place but also the data, or parts thereof, obtained during the checking and sorting operation.

Upon the recheck of the unfit bank notes in the central place by means of a bank-note processing machine, it is then possible to check on the basis of the data from the checking and sorting operation previously carried out in the decentralized place whether the sort by the decentralized place, i.e. the classification as unfit bank notes, complies with stipulated criteria coming e.g. from the central place. For this purpose, the data of the decentralized place can for example be compared with data of the central place obtained during the checking and sorting operation in the central place.

In a further advantageous embodiment, it can be provided that in addition to the data, or parts of data, of unfit bank notes, the data, or parts of data, of fit bank notes obtained during the checking and sorting operation are also transmitted to the central place.

Upon the recheck of the unfit bank notes in the central place by means of a bank-note processing machine, it is then possible to check on the basis of the data from the checking and sorting operation previously carried out in the decentralized place whether the sort by the decentralized place, i.e. the classification as unfit bank notes, complies with criteria stipulated by the central place. The data, or parts of data, of fit bank notes permit the central place to additionally make inferences about the compliance with the criteria stipulated by the central place for fit bank notes. They can also contain information on the quality of fit bank notes, such as a statistical classification of the degree of soiling.

In a further advantageous embodiment, it can be provided that at least a portion of fit bank notes is transported to the central place in order to permit a check of a defined sample.

The fit bank notes permit the central place to do a further, improved check of the quality of sorting of accepted bank notes into fit and unfit bank notes carried out by the at least one decentralized place and to assess the quality evaluation of fit bank notes. This is important in particular when the central place otherwise receives no information about the quality of bank notes that are still fit.

DESCRIPTION OF THE DRAWINGS

Further advantages of the present invention will result from the dependent claims as well as the following description of embodiments with reference to figures.

Therein is shown:

FIG. 1 shows a schematic structure of a bank-note processing machine which is suitable for use in a decentralized place.

DETAILED DESCRIPTION OF PREFERRED EMBODIMENTS OF THE INVENTION

Figure 1:
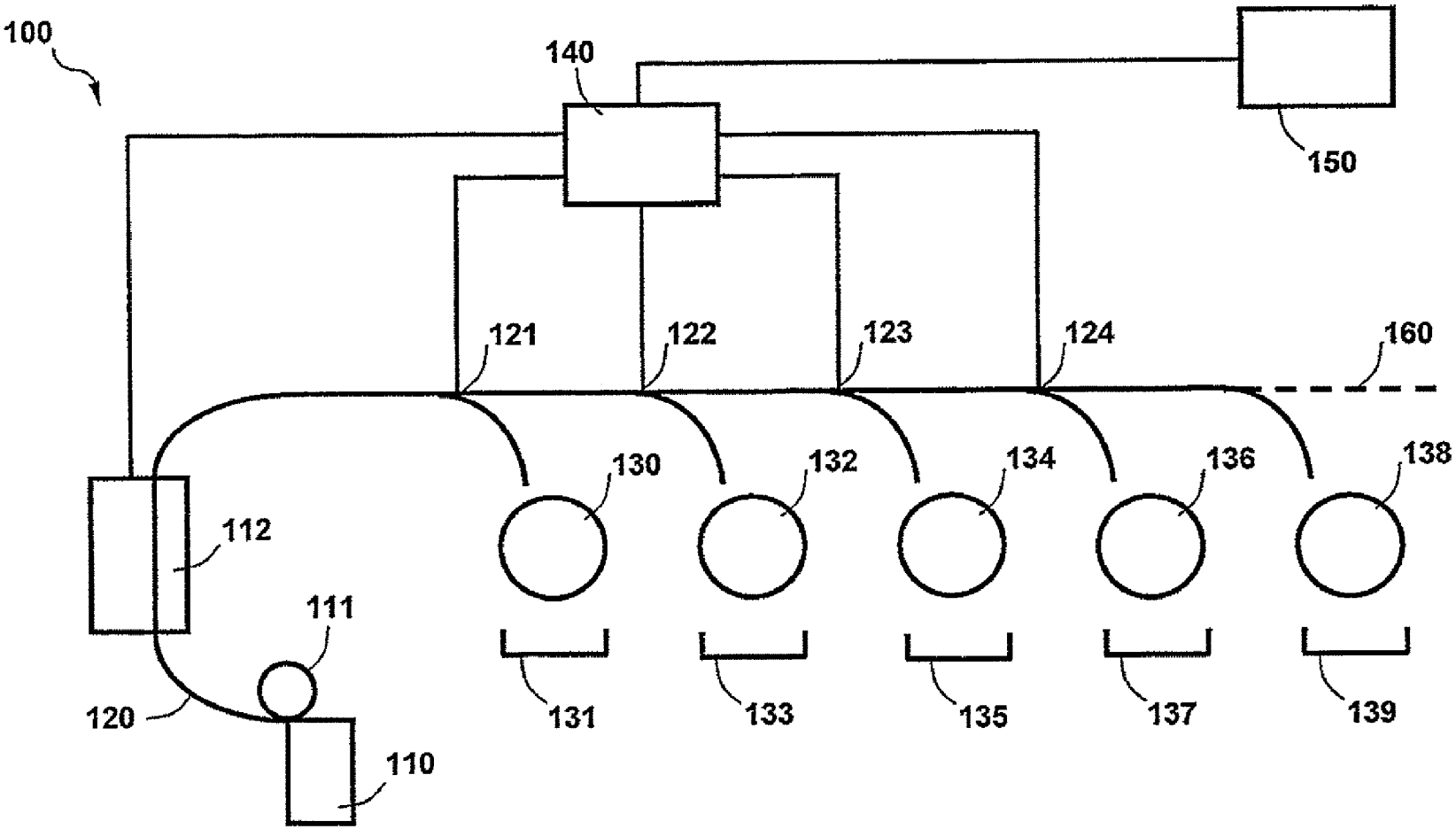
FIG. 1 a schematic structure of a bank-note processing machine for use in a decentralized place, FIG. 2 a schematic structure of a bank-note processing machine for use in a central place, FIG. 3 a schematic, simplified representation of a distribution of soiling of circulating bank notes, and FIG. 4 a schematic distribution of unfit bank notes with a contained sample for fit bank notes.

The bank-note processing machine 100 has an input unit 110 into which bank notes are inserted that are accepted and to be processed in the decentralized place, e.g. a commercial bank or security transport company. Connected to the input unit 110 is a singler 111 which removes single bank notes from the input unit 110 and transfers them to a transport system 120. The transport system 120 transports the single bank notes through a sensor device 112 which determines data from the bank notes which permit for example inferences to be made about authenticity, state, denomination, etc. The determined data of the bank notes are transmitted to a control device 140 which evaluates the data and controls therewith the further flow of bank notes through the bank-note processing machine 100. For this purpose, the control device 140 acts on gates 121 to 124 which are parts of the transport system 120 and permit it to store the bank notes in output pockets 130 to 139 according to stipulated criteria. The output pockets 130 to 139 can be configured for example as spiral slot stackers which stack the bank notes to be stored into storage bins 131, 133, 135, 137, 139 by means of rotating units 130, 132, 134, 136, 138 having spiral slots. Further output pockets 160 can follow, according to requirements. The functions of the bank-note processing machine 100 can be selected and controlled by an operator by means of an input/output device 150. The input/output device 150 can have for this purpose for example a display and a keyboard or touch screen.

Upon the sorting of bank notes into fit and unfit bank notes, the state of the bank notes is mainly determined and the bank notes are separated or sorted into fit and unfit bank notes according to stipulated criteria. In so doing, the bank-note data determined by the sensor device 112 are evaluated by the control device 140. All unfit bank notes are stored in an output pocket, e.g. output pocket 132, 133, regardless of their other properties such as currency, denomination, orientation, etc.; only bank notes that have not been clearly recognized as authentic bank notes are stored separately, as to be described below. Fit bank notes can likewise be stored in a certain output pocket or in a plurality of output pockets 134 to 139. For example, fit bank notes can be stored in one output pocket in each case according to their denomination. Bank notes that were not processible properly by the bank-note processing machine 100 or bank notes whose authenticity was not determinable are stored in a special output pocket 130, 131, the so-called reject pocket. It can be provided that bank notes are taken from the reject pocket 130, 131 to be reinputted once or several times to input unit 110 so that they can be reprocessed by the bank-note processing machine 100. For it is frequently the case that such bank notes can be processed properly by the bank-note processing machine 100 upon reprocessing and they are clearly judged as authentic and fit, or else authentic and unfit.

The result of sorting is recorded in a log containing at least the number of bank notes of each denomination (and currency) for fit and unfit bank notes. It can additionally contain information on improperly processed bank notes from the reject pocket 130, 131, in particular their number and the reason for improper processing. The information contained in the log permits determination, e.g. by the control device 140, of the total value of the bank notes, the value for a certain denomination, the value of fit bank notes, the value of unfit bank notes, etc.

Unfit bank notes are taken from the output pocket 132, 133 and transported to a central place where they are rendered useless or destroyed. For transport, unfit bank notes are packed for example in secure cassettes or other containers. Such containers can also be attached directly to the output pocket of the bank-note processing machine, so that unfit bank notes are stored directly in such a container.

Figure 2:
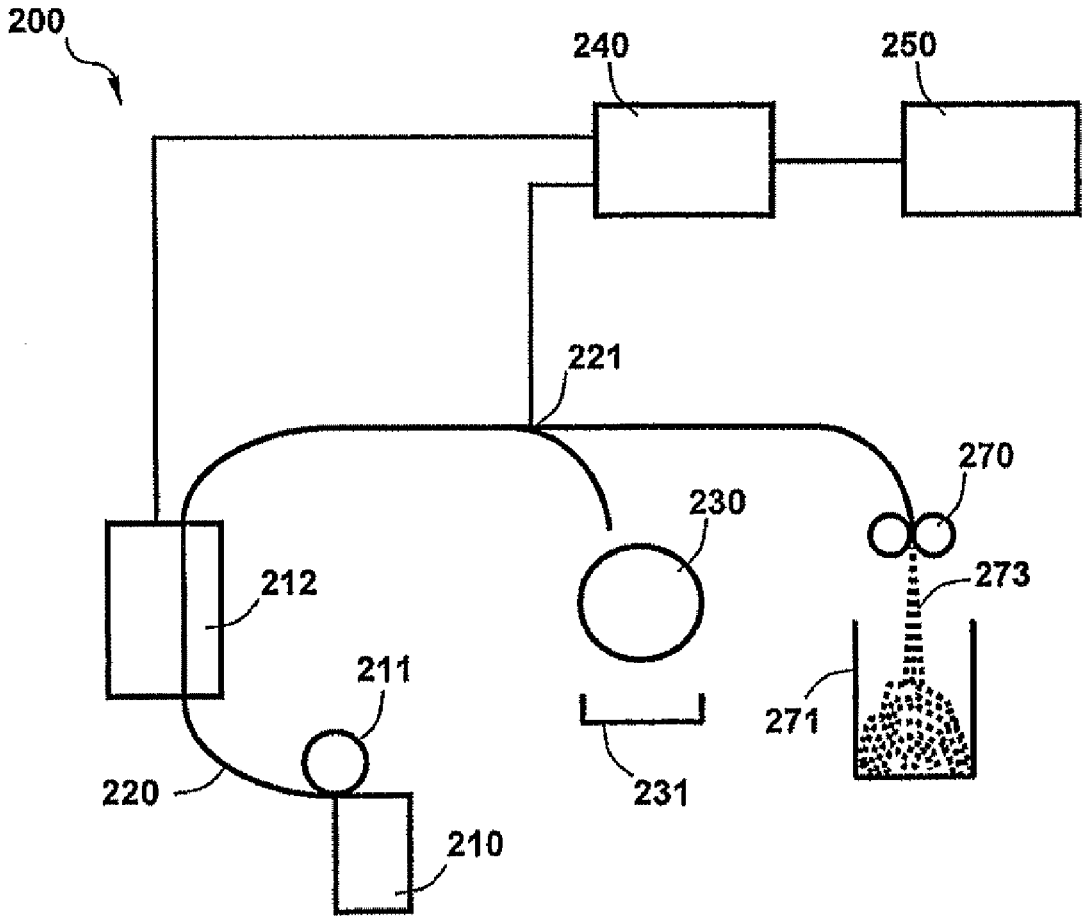

In the central place, e.g. a central bank, unfit bank notes are processed by means of a bank-note processing machine 200 whose schematic structure is shown in FIG. 2.

The bank-note processing machine 200 has an input unit 210 into which bank notes sorted out as unfit in the decentralized place are inserted. It can likewise be provided that the container used for transport is coupled directly to the input unit 210. Connected to the input unit 210 is a singler 211 which removes single bank notes from the input unit 210 and transfers them to a transport system 220. The transport system 220 transports the single bank notes through a sensor device 212 which determines data from the bank notes which permit for example inferences to be made on authenticity, state, denomination, etc. The determined data of the bank notes are transmitted to a control device 240 which evaluates the data and controls therewith the further flow of bank notes through the bank-note processing machine 200. For this purpose, the control device 240 acts on a gate 221 which is part of the transport system 220 and permits bank notes to be passed after a check into an output pocket 230, 231 or a bank-note destroyer 270, for example a shredder. The functions of the bank-note processing machine 200 can be selected and controlled by an operator by means of an input/output device 250. The input/output device 250 can for this purpose have for example a display and a keyboard or touch screen.

The functions of the bank-note processing machine 200 of the central place correspond substantially to the functions of the bank-note processing machine 100 of the decentralized place or decentralized places.

The check in the bank-note processing machine 200 of the central place can be restricted to checking the denomination and authenticity of bank notes. A check of state or quality can be omitted, since this was already checked previously and classified as unfit by the bank-note processing machine 100 of the decentralized place. If the denomination and authenticity of a bank note can be ascertained by the bank-note processing machine 200, the bank note is supplied to the bank-note destroyer 270. If authenticity and/or denomination of the bank note cannot be ascertained, the bank note is supplied to the output pocket 230, 231 which serves as a reject pocket. As described above in connection with the bank-note processing machine 100 of the decentralized place, bank notes of the reject pocket 230, 231 can also be reprocessed with the bank-note processing machine 200 in order to reduce the number of rejected bank notes.

The bank-note processing machine 200 can furthermore carry out further checks, e.g. the assignment of bank notes to different currencies. Further, it can also be provided that the bank-note processing machine 200 checks bank notes as to whether they are fit or unfit. This can serve the purpose for example of checking the sorting quality, the settings or calibration, etc., of the bank-note processing machine 100 of the decentralized place. For if bank notes previously classified as unfit by the bank-note processing machine 100 should be classified as fit by the bank-note processing machine 200, this is an indication that the bank-note processing machine 100 of the decentralized place does not comply with the criteria stipulated by the central place. In order to avoid additional effort, such bank notes recognized as fit can be destroyed by the bank-note destroyer 270 like unfit bank notes if they were properly processible, i.e. their authenticity and denomination were determined by the bank-note processing machine 200. However, it is also possible to provide one or more further output pockets into which fit bank notes are transported by the bank-note processing machine 200.

The bank-note processing machine 200 of the central place likewise takes a log of the result of sorting, containing at least the number of bank notes of each denomination. These bank notes were destroyed by the bank-note destroyer 270. It additionally contains information on improperly processed bank notes from the reject pocket 130, 131, in particular their number and the reason for improper processing. The information of the log of the bank-note processing machine 200 of the central place is compared with the information of the log of the bank-note processing machine 100 of the decentralized place. In case of proper processing, the information on number and denomination of unfit bank notes in the log of the decentralized place must match number and denomination of the central place. The log of the bank-note processing machine 100 of the decentralized place can be transmitted to the bank-note processing machine 200 of the central place for example by wire, wirelessly, over the Internet, etc. However, the log can also be present as a printout which is transported from the decentralized place to the central place. It is likewise possible that the log is stored in a memory which is transported to the central place. The transport of the log can be effected together with or separate from the bank notes, e.g. by fastening an RFID chip to the transport container.

Additionally, it can be provided that the bank-note data, or parts thereof, determined by the sensor device 112 by means of the bank-note processing machine 100 during the check and sort of the bank notes in the decentralized place are made available to the bank-note processing machine 200 used in the central place. Likewise, it is possible to make data available that are obtained, during the check, by the control device 140 from the data determined by the sensor device 112. The data comprise the properties of the examined bank notes from which the control device 140 derives statements about fitness, currency, denomination, etc., e.g. a statistical description of the quality of sorted out bank notes, a distribution of degrees of soiling, defects, etc. This makes it possible for the decisions made by the control device 140 to be checked during sorting on the basis of the data in the central place, e.g. by the control device 240.

In the central place, the data of the decentralized place permit a comparison with the data determined by the sensor device 212 or obtained by the control device 240 for bank notes delivered to the central place for destruction, upon their processing with the bank-note processing machine 200 of the central place. This permits in particular inferences to be made if the bank notes classified as unfit by the decentralized place are classified differently as fit by the central place. In this case, the data of the decentralized place can be compared with the data of the central place and inferences can be obtained which permit the different assessment of the decentralized place to be corrected. It can be provided that the data are assigned to the individual bank notes so that a direct comparison of the data is possible. This assignment can be carried out e.g. via the serial number or other individual features of the bank notes. However, it can also be provided that a statistical evaluation and a statistical comparison of the data are effected.

Besides the data of unfit bank notes, it is also possible to transmit data, or parts of the data, of fit bank notes from the decentralized place to the central place. This permits the central place to also perform an evaluation and assessment of the quality of sorting by the decentralized place with regard to bank notes classified as fit by the decentralized place.

The data obtained during the check of bank notes in the decentralized place can be transmitted wirelessly or by wire, e.g. over the Internet. The data can also be written to a memory which is transported to the central place together with or separate from unfit bank notes.

Figure 3:
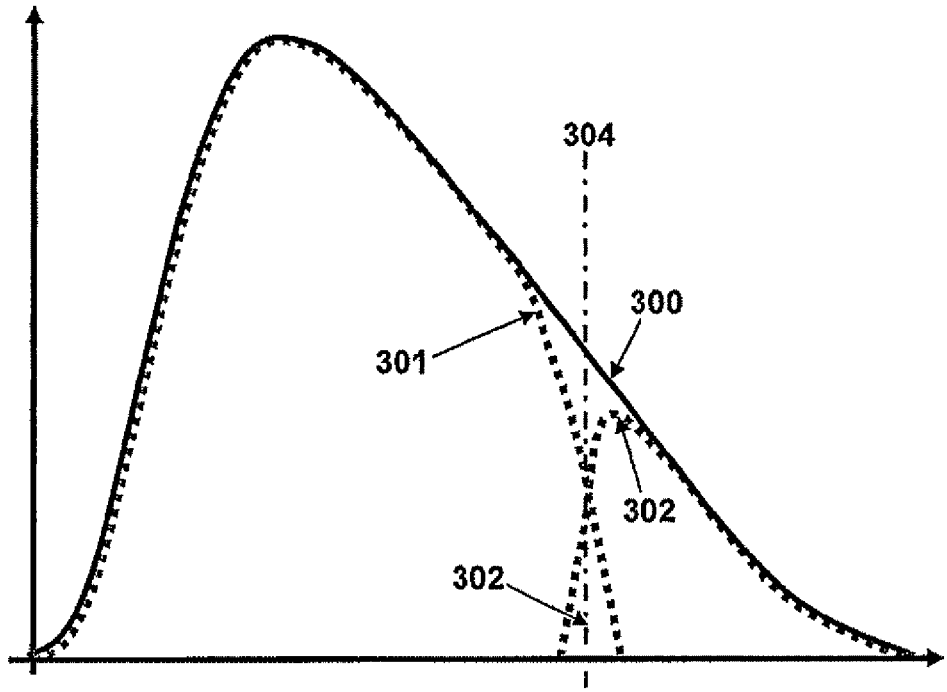

FIG. 3 shows by way of example a distribution 300 of soiling in circulating bank notes. There is shown here in each case the number of bank notes occurring in circulation per soiling level. With a sorting threshold 304 a certain degree of soiling is defined as the boundary between fit bank notes (to the left of 304) and unfit bank notes (to the right of 304). Due to real restrictions and tolerances of the sensor devices 112, fit bank notes 301 and unfit bank notes 302 are separated with a certain indeterminacy. In this indeterminate zone 303 fit bank notes are falsely recognized as unfit and unfit bank notes as fit. The width and shape of said indeterminate zone 303 is dependent on, among other things, the size of the tolerances, the calibration and the measuring precision (e.g. resolution) of the sensor device 112. In these surroundings the repeatability of determination of fitness is also restricted, so that it can happen that the same bank note is recognized as unfit in a first run, but as fit in a second run. The indeterminate zone also exists with the sensor device 212 of the central bank, but can be smaller due to more sophisticated measuring technology (e.g. with higher resolution or all-over measurement) and regular calibration.

Figure 3A:
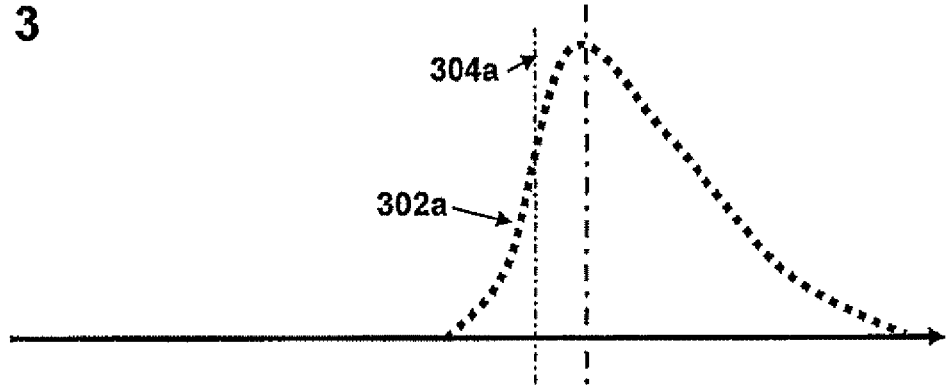
Figure 3B:
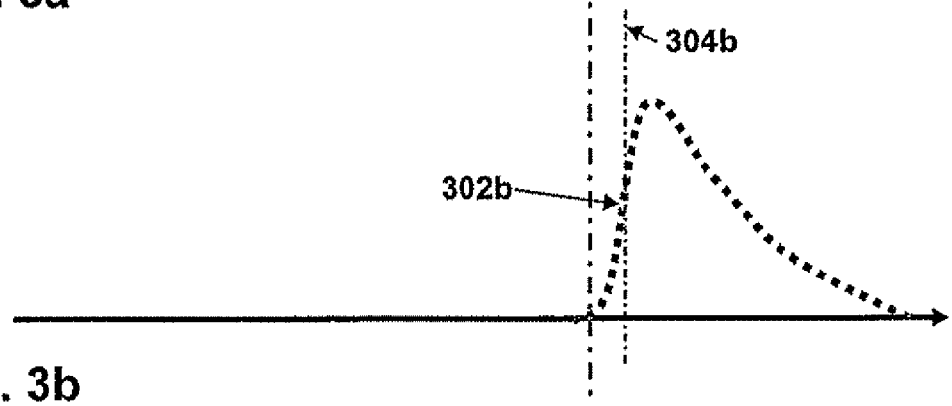

FIGS. 3*a* and 3*b* show the behavior of sorting in case of an erroneously acting sorting threshold 304*a* or 304*b*, which can result from a false setting or a faulty calibration of the sensor device 112. In this case, the sensor device recognizes 112 too many or too few fit bank notes, in addition to the unavoidable deviations due to the indeterminate zone 303. With a sorting threshold 304*a* acting too low, too many fit bank notes are sorted out as unfit. With a sorting threshold 304*b* acting too high, not all unfit bank notes are recognized as such and withdrawn from circulation, so that the quality of circulating bank notes is reduced.

Through a statistical evaluation of the distribution of soiling of unfit bank notes 302 delivered by the decentralized place, the central bank can check whether the sorting threshold 304 and/or the calibration of the sensor device 112 of the decentralized place were correctly set. If the determined distribution 302*b* has too few bank notes in the surroundings of the sorting threshold, this is an indication that a sorting threshold 304*b* set too high was used and too many unfit bank notes have remained in circulation. If the determined distribution 302*a* contains too many bank notes in the surroundings of the sorting threshold and thus too many fit bank notes, this is an indication that the decentralized place used a sorting threshold 304*a* set too low or did not carry out a sorting of fitness at all.

Figure 4:
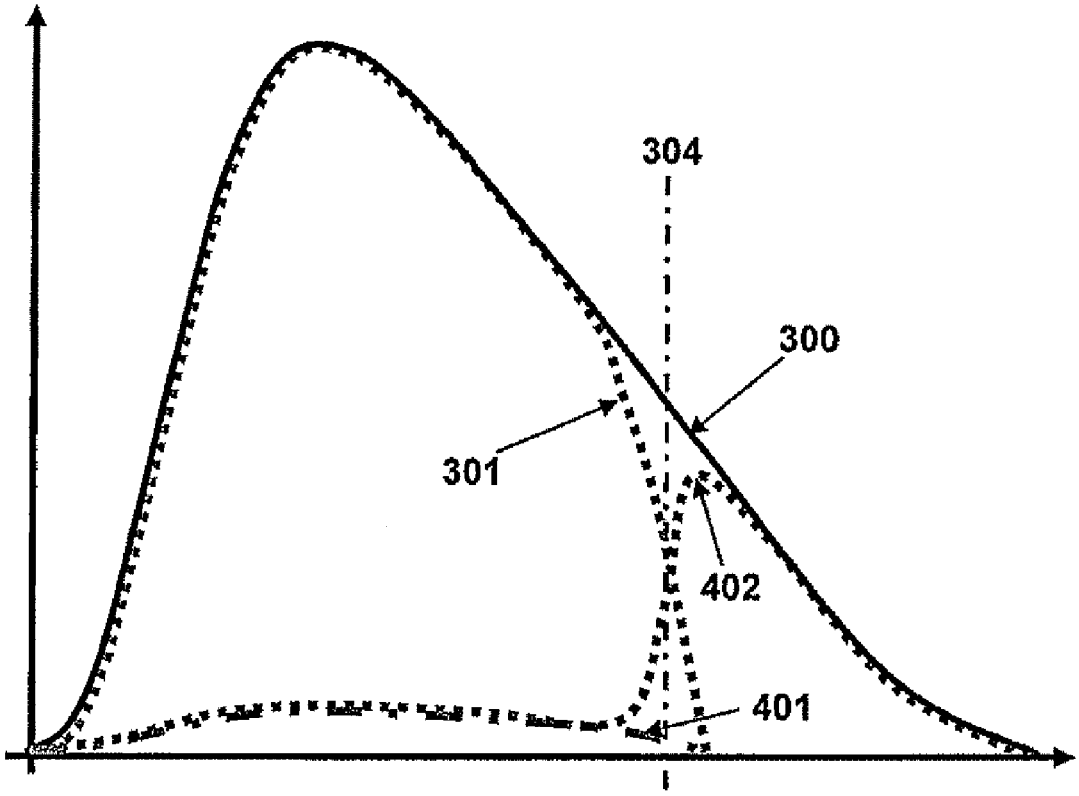

FIG. 4 shows a distribution 402 of unfit bank notes which additionally contains a sample of fit bank notes 401. Such a distribution 402 is produced by adding further bank notes recognized as fit to the bank notes 302 recognized as unfit by the sensor device 112. This can be effected for example by selecting a preset percentage of fit bank notes 301 by a random process. When the decentralized place delivers bank notes according to said distribution 402, the sensor device 212 of the central bank can then filter out the sample 401 of fit bank notes by statistical methods, thereby obtaining a real image of the quality 300 of circulating bank notes, including the distribution of soiling as well as defects and other reductions of quality through aging and wear.

In a further embodiment, the central place, e.g. a central bank, can initiate the delivery of samples of fit bank notes. This permits the central bank to make a reliable assessment of the quality of fit or circulating bank notes and to track changes (aging, wear, damage) due to use of the bank notes. On the basis of these analyses, the central bank can immediately intervene in the case of impending significant deviations from the nominal specification or objective, e.g. by changing guidelines, putting new or freshly printed bank notes into circulation, by tighter controls or changed stipulations. Additionally, the previously described data generated upon processing of bank notes in the decentralized place can also be transmitted to the central place for the bank notes of the sample. This permits any deviations occurring from stipulations to be analyzed even better.

It is advantageous when the bank-note processing machine 100 of the decentralized place, e.g. a commercial money-processing center, produces for this purpose a representative sample over a large processing volume, e.g. over the total volume of a working day. Such a sample has the advantage that it actually represents the average of circulating bank notes and random influences of specific processing sets are averaged out. It is known that bank notes have very different qualities in trade depending on the line of business, e.g. normally very good quality in first-class clothing stores and very low quality in fast-food chains. The regional origin of bank notes can also have systematic influences on the bank notes, whether due to habits in dealing with bank notes, the care of individual depositors in preparing the bank notes, or climatic influences, e.g. moisture. The choice of bank notes included in the sample can be made by random processes, or else by a target-specific selection of certain bank notes that are representative of a certain quality class and are assigned according to their share in the total circulation.

Such representatively selected samples have the advantage that small amounts already suffice for a reliable assessment of the bank notes in circulation, in particular when such samples are requested from representatively selected decentralized places or in terms of different manufacturers and types of bank-note processing machines.

The delivery of such samples of fit bank notes can be effected in separate denominations or face values, or without distinguishing the denomination. The latter has the advantage that only one further additional output pocket is needed and therefore only low extra cost incurred and the handling effort minimized. The central bank can make analyses about the quality of fit bank notes via the expected distribution of bank-note quality, e.g. degree of soiling, and possibly initiate reactions for correction. The central bank can also identify at an early stage forgeries that are already in circulation but not recognized by the commercial money-processing center because its sensors are not designed for an accordingly exact check.

In a further embodiment of the invention, a defined percentage of fit bank notes can be admixed with the unfit bank notes. This has the advantage that the sorting machine of the commercial money-processing center needs only one output pocket for bank notes to be delivered to the central bank. It is advantageous to admix only a very low percentage of fit bank notes.

In a further embodiment of the invention, basically fit bank notes with certain properties can be detected. Such properties can consist e.g. in deviations of the print or the printing tolerance, a certain serial number or a range of serial numbers. It is thus possible to remove such bank notes from circulation prematurely or to obtain extended samples over bank notes with certain properties. This can be expedient e.g. when the central bank puts modified bank notes into circulation for test purposes in order e.g. to check or compare the durability of different versions. This can also relate to the detection of registered bank notes whose serial numbers are known e.g. due to an extortion or robbery. In this case, it is expedient for corresponding data of the deliverer to be additionally detected and transmitted to the central bank.

The following statements will describe the processing of unfit bank notes. In direct analogy, the statements can also be applied to samples of fit bank notes or mixed forms without this being specifically pointed out.

The orderly storage of bank notes with different formats (depending on denomination) in a stack requires special precautions so that the stack is inherently stable for transport and can be singled as well as possible during processing in a further sorting machine. It is advantageous for this purpose when the output pocket is adjusted in length and width to the greatest occurring format, and smaller formats are stored in a certain relation thereto.

Said relation can consist in the stipulation of a certain common reference edge, e.g. the longitudinal side and/or narrow side. In this case, the time of stacking or release of the bank note from the transport system, and/or certain guiding elements and guide plates in the storage area ensure that bank notes are aligned with one or both reference edges. The use of gravity can support this alignment or optionally achieve it alone when the storage pockets are inclined accordingly. Alignment with the reference edges can be additionally supported by use of a vibrator.

Alternatively, this relation can also consist in a stipulation of central storage. In this case, the time of stacking or release of the bank note from the transport system ensures that the bank note is stored in the center. Such a method is possible e.g. when the system has a picking device and the picking time is controllable according to the length or width of the bank note. Such a picking device is known e.g. from EP 0 854 833 B1.

The relation can consist in a combination of the two possibilities, e.g. a common reference edge with regard to the longitudinal side and a central storage with regard to the longitudinal side. Said combination is particularly suitable for further processing in a bank-note processing machine with transverse singling, as described e.g. in EP 1 238 375 B1.

Alignment with a certain longitudinal side and narrow side as reference edges is particularly suitable for systems with longitudinal singling and a transport system with a fixed reference position relative to the base plate of the bank-note transport, as described e.g. in EP 0 764 131 B1.

Alignment with a certain narrow side as a reference edge and with central storage in said narrow side is particularly suitable for systems with longitudinal singling and a transport system with a symmetrical belt system.

Central storage with regard to both the longitudinal side and the narrow side is particularly advantageous for the stability of the bank-note stack. With this relation, the danger of tipping over and sliding apart is lowest. However, it is normally not particularly suitable for conventional singlers of bank-note processing machines.

Unfit bank notes collected in the output pocket can be prepared for transport to the central bank in different ways.

The simplest possibility of transport is e.g. banding into packs of 100 bank notes or as bundles (blocks) of 10 packs or 1000 loose bank notes, e.g. by shrink-wrapping into a transparent film. Said film can be so designed that tampering is recognized, e.g. by optically visible damage to the film or by loss of vacuum (vacuum packaging). The proof of tampering can be furnished, or the integrity (intactness) of the deposit can be checked, when test substances are sealed in during production of the bundle which cause either visible or invisible color reactions upon opening, or the certain test substance is no longer completely present upon delivery or deposit in the central bank.

The processed packs can also contain a variable number of bank notes, however, in order to obtain e.g. a stipulated value or minimum value per pack or not to exceed a stipulated maximum value per pack. The information about the value of a pack and the number of bank notes can be printed on in plain text or via a bar code. It is particularly advantageous to dispose such bar codes or other machine-readable information on the band on the narrow side of the packs. The information can then also be detected when the packs are present in stacked form.

In another embodiment, an electronically readable label (smart label) on the band can also be used for storing the information. Using a contactless RFID method, the information of all packs contained in a stack can be read at the same time.

These methods have the advantage of permitting the monitoring of the value or completeness of the stack to be checked more easily.

A further possibility of transport is to use containers or cassettes which are designed according to the bank-note formats. Said containers can have closing mechanisms, e.g. in the form of a seal or a lock, which can only be opened by certain tools present with the recipient. Said containers can be so designed that they can be filled and locked or sealed fully automatically or semiautomatically in the bank-note processing machine of the commercial money-processing center. A further embodiment is the possibility of said container being opened automatically in the bank-note processing machine and the bank notes being singled therefrom without manual intervention by an operator.

In case of mixed formats with different lengths and/or widths of the bank notes, the bank notes must optionally be secured with additional means in the container, so that protruding large bank notes are not bent or small bank notes are held reliably. This can be effected by a corresponding design of the transport container, e.g. pockets of a certain or variably adjustable size or pressure by means of a spring, so that the bank notes cannot slip. Such a mechanism can also serve to prevent slipping when containers are only partly filled.

A further possibility of transport can be effected by using plastic bags closed by a seal (safe bags). In this case, bank notes are normally inserted loose. It is in principle also possible to collect them unordered in a sack or other container.

In all above-mentioned possibilities of transport it is necessary to identify the deposit. This consists e.g. of the name of the deliverer, a possibly assigned bank code or another standardized identification, the number of bank notes per denomination and/or the value of the deposit, the date of processing, the operator, the identification of the bank-note processing machine.

For tracking bank-note quality, it can be advantageous when data regarding the quality or sorting results of the contained bank notes are also detected during sorting. This can relate e.g. to statistical data such as the distribution of degree of soiling, the frequency and type of defects or other description-relevant data for the composition of the deposit. Further data can include the setting of the bank-note processing machine as well as further parameters of processing.

Further data that can likewise be detected are the serial numbers of the sorted bank notes. Said serial numbers can be used for uniquely identifying the individual bank notes, and the above-described data, e.g. on degree of soiling or defects, can be stated individually for each bank note.

Individual recognition of the bank note can also be carried out, instead of or in addition to the serial number, through other individual features of the bank note, e.g. deviations from the printing tolerance, special properties due to use of the bank note, etc. For this purpose, the data detected by the sensor unit can be used, as described more precisely for example in DE 10 2004 033 092 A1. Likewise, an individual recognition of bank notes is possible by means of specifically provided features such as an invisible bar code or other individually applied patterns.

In a further embodiment, additional data can be detected which relate to the reissue of fit bank notes by the commercial money-processing center. This can relate e.g. to the amount of bank notes, the distribution of degree of soiling and all further above-mentioned data.

On the basis of such data the central bank can check whether the bank-note processing machine of the commercial money-processing center was operated with the right parameters or settings for sorting unfit or fit bank notes and whether the measurement results for degree of soiling and defects comply with the stipulations of the central bank for calibration or adjustment of the sensors. This can be effected most simply by the central bank comparing the results it itself has determined for the composition of the deposit with the data transmitted by the commercial money-processing center. This can be carried out on the basis of the statistical data or on the basis of the individual bank notes via the serial numbers or other individual features. If there are substantial deviations from the stipulated deposit conditions, the central bank can issue instructions for changed settings or adjustments of the bank-note processing machine of the commercial money-processing center in order to eliminate the deficiency. The central bank can also initiate a check of the bank-note processing machine on site in order to ascertain the reason for the deviation. The central bank can optionally charge fees to cover the costs incurred by the deviations. Such costs can arise e.g. from fit bank notes being falsely included and therefore destroyed unnecessarily.

Normally, there is present on the bundle or transport container at least one information carrier which permits unique identification of the delivery of unfit bank notes.

In the simplest case, this is a bar code whose unique information or number refers to further data which are transmitted or input in another way. A one-dimensional bar code can store only a small amount of information due to the restriction of information content. Upon use of a two-dimensional bar code it is possible to store and transmit considerably more information.

Alternatively, an electronic chip (smart label), preferably with contactless transmission (RFID), can be provided as an information carrier on the bundle or transport container, so that all above-described data can be stored and transmitted.

The data of the information carrier are read by the central bank with corresponding reading devices. Said reading can be effected upon acceptance (receipt) or in the course of processing in the bank-note processing machine.

Instead of or in addition to the data transmitted with the bundle or transport container, further data can be transmitted by electronic means. The bank-note processing machine of the commercial money-processing center detects the described data during processing of bank notes and generates a corresponding electronic log at the end of processing or upon termination of a deposit unit. Said log is transmitted electronically to the central bank, e.g. via the networking by Internet or other WAN (wide area network) interfaces. The XML format is preferably used for the electronic log, since it can be processed further by many standard tools, e.g. by being read into a database. Furthermore, the XML format has the advantage that it is largely independent of the internal representation of the bank-note processing machine and is as such machine-independent and version-independent, i.e. an open standard. Such logs can therefore be generated by bank-note processing machines of different manufacturers when the central bank or another organization has stipulated and standardized the format and contents of the log.

Instead of electronic transmission, the data can also be printed on paper as a log and optionally be added to the bundle or transport container.

By an additional authentication of the detected and transmitted data it can be discovered when the data transmitted on the information carrier, on the electronic log or on the paper have been impermissibly changed. Such an authentication is effected e.g. by a cryptographic processing on the basis of secret keys, e.g. DES or RSA methods or other well-known methods of encryption. Alternatively, the total information can be encrypted so that it cannot be read by unauthorized persons, or only a signature, e.g. message authentication code (MC), is added at the end of the data or printout so that the integrity of the transferred data can be checked. Other methods can also be used for encryption, e.g. the PKI (public key infrastructure) method.

The key for this authentication can e.g. be stipulated by the central bank and stored in the bank-note processing machine so securely that the commercial money-processing center has no possibility of changing the determined data. This method permits the central bank to check and monitor the bank-note processing machine operated by the commercial money-processing centers and the bank-note processing performed therein.

The authentication can also comprise the programs and/or parameters as well as the settings of the sorting machine. Thus, the central bank can check e.g. whether the (authorized) method approved by the central bank is actually used for checking the bank notes.

The singling of unfit bank notes in mixed formats makes increased demands on the efficiency of the sorting-machine singler, in particular when bank notes are delivered without any alignment along a reference edge. In this case, aligning elements and feed elements must ensure that bank notes are supplied to the singler and that bank notes are aligned e.g. with a reference edge of the transport system before they are supplied to the area of the sensors. If alignment is incomplete there is a danger of singler stops or singling gaps, of multiple feeds or additional rejections, because the sensor unit cannot reliably evaluate bank notes with a skew or an excessive distance from the reference plane of measurement (float).

The problem can be partly solved when the sensors measure over the entire surface, and the quality and reliability of evaluation is independent of skew and float. This is the case in particular when the sensors have a sufficient number of measuring tracks and can evaluate bank notes with a corresponding tolerance or can transform the measured signals after determination of the skew and float to the nominal position of the reference data. This has the disadvantage, however, that the production costs of the sensors are increased. Also, disturbances can occur in the transport system at gates and other critical places and the aligned storage of the bank notes in the output pockets might not be ensured.

It is known from DE 102 36 028 A that bank notes can be aligned in the transport system, i.e. in the singled state, by a mechanical apparatus or a contactless intervention, e.g. by a corresponding air stream. The intervention is effected until the bank note is completely aligned (see also WO 2004/014768 A). It is known from EP 1 253 097 A that bank notes can be aligned after singling by a position correction portion both with regard to float and with regard to skew. These two methods permit the processing of basically unaligned bank notes by causing a corresponding alignment between the singler and the sensors. The stated methods are disadvantageous in that bank notes are only aligned in the transport path and therefore disturbances can already occur in singling. Furthermore, such aligning apparatuses require additional installation space in the sorting machine and increase the production costs of the sorting machine.

It is known from EP 0 946 402 A that bank notes can already be pushed against a mechanical stop by a mechanical aligning device during the singling process and thereby be aligned. Aligning bank notes during the singling process by means of compressed air is known from DE 28 14 306 A and is also possible at higher singling rates. A suitable arrangement of blown air bores produces feeding and aligning forces which align and single the bank notes.

An apparatus in the area of the singler, according to the principle of alignment described in DE 102 36 028 A, permits a very compact and economical solution. Using a camera the format of the next bank note to be singled is recognized and its position relative to the nominal position for optimal positioning for singling is measured. The air baffle plate has fields with blown air nozzles, said fields being controllable independently of each other. Said fields have different acting directions and different acting zones, so that advancing, aligning and rotating forces can be controlled independently of each other. A separate drive permits singling to be so optimized that skew, float and double feeds are prevented. This is effected e.g. by a control device activating the individual fields of the air baffle plate simultaneously or sequentially such that each next bank note to be singled is first aligned completely with the reference edges of the singler before the onset of singling and then the feed is activated according to the format of said bank note.

The feed for singling must likewise meet higher demands in the processing of unfit bank notes. In high-quality singling apparatuses the bank notes are guided to a picking device from below, so that the weight and the number of bank notes contained in the input stack do not substantially influence the behavior and performance of the singler. The feed must normally be so controlled that the bank-note stack is guided close enough to the picking device but the uppermost bank note in the input stack exerts no, or only a defined, vertical pressure force on the picking device. If the distance is too great, singling is interrupted; if the distance is too small or the pressure force too great, there is a danger of a plurality of bank notes being drawn in at the same time. This feed is more difficult when the input stack is very large, because in particular used and above all unfit bank notes are normally compressible and thus the height of the input stack is not proportional to the number of bank notes. In the processing of deposits of unknown size, the amount of bank notes contained therein is moreover unknown. Small input stacks have the disadvantage that singling must be stopped when the next input stack is loaded. If a feed mechanism is used that permits continuously loading of new input stacks, as described e.g. in EP 0 764 131 A, the stack can give way and be compressed when the input stack located in the singling position is combined with the loaded new stack.

The feed must therefore be effected nonlinearly with the help of a control or regulation means in dependence on the stack height. The method according to EP 0 865 398 A for regulating the feed uses a density sensor with which the density of bank notes in the immediate area below the singler is ascertained. The density sensor can comprise an optical sensor, e.g. by counting the density of bank-note edges, via the measurement of oscillations or noises of a blown air nozzle or an air pressure sensor.

With unfit bank notes there are higher rejection rates, despite all technical optimizations and good preparation of the bank notes, when the bank notes have not been clearly recognized by the sensors. A repeated singling of these rejected bank notes in a rerun can considerably reduce the remaining rejection rate, since bank notes are singled with fewer multiple feeds and less skew or float in a second try. The execution of such a rerun is facilitated when the singler has a separate input pocket therefor, so that these bank notes can be inserted separately from a next input stack, e.g. a deposit from another depositor, and do not mix therewith. Said further input pocket can be simply realized in an apparatus similar to EP 0 764 131 A by the means of the singler, after the end of singling of a first input stack, parking in a specially defined position above a next available input stack and standing by to receive the rejected bank notes. The operator can utilize this park position by inserting initially rejected bank notes and having them rechecked after actuating the start key for the rerun. Alternatively, he can actuate the start key for the singler to omit this recheck and start processing of the next input stack. During the machine processing of the next input stack, the operator can carry out the inputs for manual reworking of the first input stack by checking the rejected bank notes and inputting them in an input mask according to their value, so that after termination of the input the bank-note processing machine can determine the value and number of bank notes of the various denominations of the first input stack and optionally compare them with a transmitted nominal value.

The possibilities of optimization stated in connection with the singler exist generally and are not restricted to the processing of unfit bank notes.

The sensor units must reliably recognize the denominations and clearly detect their authenticity. This check is effected on the basis of distinguishing features of the individual denominations with regard to their size, their printed image as well as further physical features, e.g. properties in the invisible spectrum, magnetic and/or conductive components in the printing ink or security thread, paper properties such as watermarks, etc.

Unfit bank notes are frequently very dirty, stained and/or damaged. Such defects can be caused by missing parts, dog-ears, folds, holes, tears, dog-ears, broken or partially missing security threads. In such cases, it can happen that an actually authentic bank note is not clearly recognized by the machine and is rejected, i.e. output to the reject pocket. In this case, the operator can temporarily repair the bank note, e.g. unfold a dog-ear, stick transparent adhesive tape over a tear, and reinput the bank note to the machine for a rerun. In some cases, it may also be sufficient to supply the bank note in a different orientation. In the case of serious defects, it may be that the machine cannot identify the bank note even after several tries.

The remaining rejected bank notes must be checked manually and subjected to an alternative destruction method. These manual interventions and methods are undesirable, since they require considerable time and reduce the performance of the sorting machine.

It is therefore particularly advantageous when the sensors work very reliably and nevertheless tolerantly when recognizing the denomination. Reliable identification can be improved by a combination of measured properties. It can be so designed that in the case of certain defects, other local areas of the bank note or other criteria are alternatively used for determining the denomination and/or authenticity. This can also be effected by the combination of signals from the front side and rear side of the bank note or by the combination with different measuring principles, e.g. optical and magnetic sensors, as described for example in DE 102 59 288 A.

A smudge or hole in the bank note in a certain place can impede e.g. the identification of denomination when this area contains essential information for the decision logic for distinguishing denomination or detecting orientation of the bank note. In this case, it can happen that the decision logic yields a false result. Said false result is normally recognized in a second stage by a verifier which also checks further criteria. In this case, an alternative algorithm can be used which takes other areas of the bank note into account and then arrives at a verifiable result after all. This process can also be repeated several times.

The detection certainty of denomination can be improved further by the database containing a multiplicity of new and used bank notes for evaluating the distinguishing features of the various denominations. The result is particularly stable and reliable when all printing tolerances and the typical defects are taken into account, e.g. bank notes with dog-ears, bank notes with creases or folds in one of the two center lines and bank notes in all relevant degrees of soiling.

A further method for improving denomination recognition is the use of visible or invisible codings of the bank note. This can be effected e.g. in the form of bar codes which are evaluated in the ultraviolet or infrared spectrum.

The possibilities of optimization stated in connection with the sensors exist generally and are not restricted to the processing of unfit bank notes.

Recognized and identified bank notes must be transported safely to their destination and counted reliably. The machine control by the control unit tracks the bank notes for this purpose via light barriers on the entire path of their transport from the singler to the destination determined by the sensors, e.g. the shredder. The accounting of the value of the deposit is effected on the basis of the denomination determined by the sensors.

The machine control must work particularly reliably in the case of processing of unfit bank notes with mixed denominations. The danger of transport disturbances is substantially higher with damaged bank notes than with freshly printed or used fit bank notes. Bank notes can e.g. be delayed, blocked or torn at certain constrictions or branchings (gates) of the transport system. The machine control must stop the bank-note processing machine when clear tracking and assignment of transported bank notes is no longer ensured, and ask the operator to check the transport path or the content of an output pocket (e.g. by recounting).

It is therefore advantageous when the machine control or transport tracking tolerates delays of bank notes or the tearing of bank notes in the transport path as long as this does not cause a miscount or erroneous accounting. This can be effected e.g. by reacting to a delay of a bank note more tolerantly in the first part of the machine or in the area of the sensors than in the area of the output pockets. Bank-note singling can be briefly stopped in the case of a transport disturbance and then continued if no real jam is present and/or the operator must only be asked at the end of processing of the deposit to check this area for bank notes that are blocked, have fallen out or been torn, so that a plurality of transport disturbances are optionally covered.

In further embodiments, the machine control can be optimized, e.g. by a location-dependent reaction to transport disturbances. The stopping of singling, the stopping of the transport system and the switching of the gates are coordinated here in an optimal manner such that the operator need perform as few interventions as possible to eliminate the transport disturbance and the operation of the sorting machine need only be interrupted briefly. After a bank-note jam in the area of the sensors, the transport system can e.g. be operated until the bank notes that already passed the jam point before are stored in the intended or previously specified output pockets. For the shredder, this can mean that the drive of the shredder blades is only switched off when the supplied bank notes are completely destroyed.

In the processing of bank notes with transparent windows, additional problems can occur. Said windows are added as an additional visible authenticity feature and are intended to impede forgery and are frequently located near the edge of the bank note. Light barriers with at least two measuring tracks are normally used for tracking the bank notes. When bank notes are damaged at the edge, reliable recognition of the leading edge or trailing edge of the bank note in the transport system can be impaired. Faulty edge detection can occur when e.g. a transparent window is located in one measuring track and simultaneously a dog-ear or missing corner or part is present in the other measuring track. Said faulty edge detection can be avoided when the signals of the light barriers are evaluated so intelligently that the exact edge detection is retained even upon a short interruption of the signal. This is effected for example by regarding the edge detection only as preliminary during a maximum occurring window size and accepting it as final only thereafter. For the further calculations the time is then used at which parts of the bank note were detected for the first time for the leading edge or for the last time for the trailing edge. Such a method is described for example in the non-prepublished patent application DE 10 2005 008 747.

In the area of the output pockets and in particular in the area of the shredder, a reliable assignment of denomination of the bank note is very important for correct accounting. In this case, the elimination of transport disturbances and jams is effected on the basis of a comparison of data expected by the bank-note processing machine with data input by the operator in the course of trouble-shooting. In the area of the shredder there can arise an uncertainty, e.g. upon a delay of transport of a plurality of bank notes with different denominations, as to which bank notes are already destroyed and which are still present completely or are only partly destroyed. When the operator inputs the number of found bank notes per denomination, this can be checked against the expectation of the machine control. This can relate to the selection of the denominations occurring in this case at all. Further, this selection can be limited by detected transport data, e.g. the times of leading edges or trailing edges at light barriers, the determined length and/or width of objects from the light-barrier events or other measurement results, as described e.g. in DE 101 11 907 A1.

In particular in the case of poor bank-note qualities, it is to be observed that the bank-note processing machine is contaminated by dust (e.g. due to detachment of printing ink or paper dust) or by bank-note particles (e.g. torn-off corners or parts of bank notes, torn-off security threads or applications, etc.), thereby disturbing the function of the sensors and the transport system (in particular light barriers). The dust can also be a health risk for the operating staff. Dust and particles arise chiefly in places where bank notes are accelerated or bent or otherwise influenced mechanically. This relates to the singler, the measuring path and in particular the sensor unit, which exerts forces or deformations on the bank note due to its measuring principle, e.g. mechanical sensors for measuring limpness or recognizing tears.

This can be remedied by removal by suction using suction units, e.g. a vacuum cleaner installed inside or outside the bank-note processing machine, or a vacuum pump. Alternatively, it is also possible to use the vacuum pump (compressor) for the singler or the suction device for disposing of shredded bank notes from the shredder. The suction can act selectively on certain areas or also over a wide area on the total sorting machine.

The sensors are likewise impaired in their function by dust, particles and/or smeared dirt. This relates in particular to optical sensors when dust on the illuminating means or in the optical path reduces contrast or sensitivity, or dirt deposits cover certain parts or strips of the bank note. For the operability of the bank-note processing machine it is essential that such impairments are recognized in good time so that missorts are avoided. Missorts can occur through non-recognition of bank notes or through a false classification of a basically fit bank note as unfit because dust or dirt in the optical path is evaluated as soiling or staining on the bank note. After recognition of such an impairment it is advantageous when the sorting machine can first remove the dust or dirt automatically, i.e. without intervention by an operator. This can be effected e.g. by blowing compressed air. The duration and intensity of such compressed-air pulses and the formation of the compressed-air jet, e.g. via a Lavalle nozzle, is essential for the effect and efficiency of such a cleaning device. Alternatively, the automatic cleaning can also be effected by introducing cleaning agents, e.g. solvents. The residues after cleaning can be vaporized, wiped off on the principle of a windshield wiper and/or removed by compressed air or suction.

The light barriers of the sorting machine are likewise impaired in their function by dust, particles and/or smeared dirt. The light barriers are used for tracking bank notes in the transport system and for checking the output pockets. Other functions of the sorting machine can also be controlled by light barriers, e.g. motion events during transport or storage of bundled bank notes or monitoring of the position of actuators. In the case of dust deposits, it can happen that a light barrier falsely outputs a signal for the covered (interrupted) state.

The problem can be solved by checking the soiling of the light barriers continuously or in certain states of the sorting machine and triggering an action if a safe switching distance is undershot. Such an action can comprise the triggering of a compressed-air pulse for cleaning the light barrier or a message to the operator, e.g. a request for cleaning. Alternatively, the intensity of the emitted light ray from the light barrier can also be increased, or the switching or recognition threshold adapted to the changed sensitivity or changed operating point of the light barrier. All these methods can also be used in combination.

The above-described solutions to the problems arising from soiling are not restricted to unfit bank notes.

The invention claimed is:

1. A method for destroying bank notes, comprising the steps:

checking and sorting bank notes using at least one bank-note processing machine in at least one decentralized place, in a manner such that unfit bank notes are sorted out in order to be transported to a central place for destruction;

said sorting step being carried out so that all bank notes recognized as authentic but unfit are stored, without being mixed with fit bank notes or bank notes whose authenticity is not determinable, on a single stack independently of any bank-note denomination and/or orientation recognized during the checking step;

using a single output pocket of the bank-note processing machine to store all bank notes recognized as authentic but unfit; and sorting out samples of fit bank notes using the bank-note processing machine of the decentralized place so that they can be transported to the central place together with unfit bank notes.

2. The method according to claim 1, including processing bank notes contained in the single stack in a single run, and destroying unfit bank notes in the central place.

3. The method according to claim 1, including transmitting unfit bank notes according to their number and type to the central place.

4. The method according to claim 1, wherein data of unfit bank notes obtained during the check of bank notes in the bank-note processing machine of the decentralized place are transmitted to the central place, said data describing properties of the unfit bank notes from which statements are obtainable at least about the fitness of the bank notes.

5. The method according to claim 1, wherein data of fit bank notes obtained during the check of bank notes in the bank-note processing machine of the decentralized place are transmitted to the central place, said data describing properties of the fit bank notes from which statements are obtainable at least about the fitness of the bank notes.

6. The method according to claim 1, wherein individual features of the bank notes are detected during the check of bank notes in the bank-note processing machine of the decentralized place and transmitted to the central place.

7. The method according to claim 1, wherein the sorting of bank notes by the bank-note processing machine of the decentralized place is checked by the central place, for which purpose it is ascertained whether the bank-note processing machine of the central place likewise sorts as fit and/or unfit bank notes sorted as fit and/or unfit by the bank-note processing machine.

8. The method according to claim 7, wherein statistical data of the decentralized place are additionally evaluated and compared with corresponding statistical data of the central place for the check in the central place.

9. The method according to claim 7, wherein the check in the central place is effected on the basis of data of the decentralized place which are assigned to the individual bank notes via the individual features.

10. The method according to claim 7, including checking in the central place the frequency distribution of unfit bank notes in the borderline range to fit bank notes and recognizing a sorting threshold set too high or faulty calibration of the sensor of the decentralized place.

11. The method according to claim 1, including sorting the samples of fit bank notes into the output pocket of the bank-note processing machine of the decentralized place into which unfit bank notes are stored.

12. The method according to claim 1, wherein the single stack comprises banded packs each having a stipulated number of bank notes.

13. The method according to claim 1, wherein the single stack comprises banded packs with a stipulated value or stipulated minimum value.

14. The method according to claim 12, wherein the band of the packs has information about the number of contained bank notes and/or about the value of the pack.

15. The method according to claim 14, wherein the information is applied to the band so as to be located on a narrow side of the packs.

16. The method according to claim 14, wherein the information is written to an electronic circuit of the band, and the information of the packs is jointly detected contactlessly.

17. The method according to claim 1, wherein the sorting step further includes identifying fit bank notes and storing the fit bank notes separately from the unfit bank notes in additional output pockets according to a denomination of the fit bank notes.

18. The method according to claim 1, wherein the sorting of bank notes by the bank-note processing machine of the decentralized place is checked by the central place, and inferences are obtained which permit different assessments of the bank-note processing machine of the decentralized place to be corrected.

* * * * *